US008869453B1

(12) United States Patent
Jordan

(10) Patent No.: US 8,869,453 B1
(45) Date of Patent: Oct. 28, 2014

(54) HUNG EGRESS WINDOW

(71) Applicant: William M. Jordan, Bainbridge, GA (US)

(72) Inventor: William M. Jordan, Bainbridge, GA (US)

( * ) Notice: Subject to any disclaimer, the term of this patent is extended or adjusted under 35 U.S.C. 154(b) by 0 days.

(21) Appl. No.: 13/843,837

(22) Filed: Mar. 15, 2013

(51) Int. Cl.
*E05D 13/00* (2006.01)

(52) U.S. Cl.
USPC ..... 49/458; 49/404

(58) Field of Classification Search
USPC ..... 49/404, 458, 453, 454, 455, 456, 457, 49/459
See application file for complete search history.

(56) References Cited

U.S. PATENT DOCUMENTS

| | | | | | |
|---|---|---|---|---|---|
| 794,024 | A * | 7/1905 | Keighley | 49/452 |
| 1,099,184 | A * | 6/1914 | Leonard | 49/149 |
| 1,392,183 | A * | 9/1921 | Lane | 49/452 |
| 1,686,668 | A * | 10/1928 | Lane | 49/424 |
| 1,750,110 | A * | 3/1930 | Klim et al. | 49/459 |
| 3,055,468 | A * | 9/1962 | Horejs et al. | 52/393 |
| 3,099,050 | A * | 7/1963 | Hetman | 49/421 |
| 3,105,576 | A * | 10/1963 | Jones et al. | 49/172 |
| 3,377,747 | A * | 4/1968 | Donkin | 49/414 |
| 5,280,686 | A * | 1/1994 | Davies | 49/209 |
| 5,446,997 | A * | 9/1995 | Simonton | 49/458 |
| 7,716,875 | B2 * | 5/2010 | Langner | 49/458 |
| 8,191,313 | B2 * | 6/2012 | Ito et al. | 49/181 |

* cited by examiner

*Primary Examiner* — Jerry Redman
(74) *Attorney, Agent, or Firm* — Peter Loffler

(57) ABSTRACT

A hung egress window allows the operable lower sash to travel a greater distance relative to a prior art hung window in order to give more clear space height for a given size window. This additional travel distance is achieved by lowering the location of the top rail of lower sash to be substantially below the bottom rail of the upper sash except where the seating flange of the top rail seats within a gasket lined seating pocket of the bottom rail of the upper sash. Additionally, the profile of the sill is lowered so that a portion of the flanges of the glazing pocket of the lower sash visibly extend above the sill.

9 Claims, 5 Drawing Sheets

HUNG EGRESS WINDOW

BACKGROUND OF THE INVENTION

1. Field of the Invention

The present invention relates to a single hung or double hung window, including a side hung (slider) window, that has code meeting egress capabilities without the need for a separate casement system as would be required for a single hung window of the same size.

2. Background of the Prior Art

According to the International Building Code, all bedrooms of a residential dwelling must have egress capabilities directly to the outside of the dwelling in order to allow the occupants in the bedroom to escape immediately to the exterior of the building in case of an emergency such as a fire, and to allow emergency personal to enter the dwelling to rescue any occupants that may still be therein as well as to combat the emergency. Such egress capabilities are typically achieved in one of two manners. One way to achieve code meeting egress is via a door that leads directly to the outside of the dwelling. Barring a door, the other means to achieve egress is via a window that leads directly to the outside of the dwelling. Such a window must meet certain requirements. Under the current International Building Code, an egress window must have all of the following features: 1) the top of the sill cover at the base of the window cannot be more than 44 inches from the floor; 2) the clear space width, the so-called vent space, must be at least 20 inches in width; 3) the clear space height between the top of the sill cover at the base of the window and the bottom of the bottom rail of the upper sash of the window must be at least 24 inches; and 4) the open vent space must be at least 5.7 square feet, this last requirement being the minimum vent spaced needed, in combination with requires 2 and 3, for a firefighter carrying a breathing tank to be able to enter the structure.

In new construction of dwellings, achieving egress is not usually a problem as the architect simply assures that at least one egress point meeting the International Building Code is designed into the dwelling and the contractor assuring that this egress point is actually built according to specifications. The problems occur during remodels of existing dwellings, especially older dwellings that may have been built prior to the adoption of the current International Building Codes or any other code for that matter. Many jurisdictions require that during a remodel, especially a sizable remodel, that each bedroom be brought up to the current International Building Code relating to egress. Some jurisdictions go as far as requiring the bedroom be brought up to code during as simple a procedure as replacing a single window within the bedroom either due to life span fatigue of the existing window or to bring in a more energy efficient window such as replacing a single pane window system with a double pane insulated window system.

If the window or windows being installed are a hung (either a single hung or a double hung) problems often arise as many older structure's bedroom windows have a relatively short height, as such short heights were common in construction techniques decades ago for a variety of reasons. Modern hung windows allow the clear space height of the window to be substantially less than 50 percent of the overall height of the window, despite the fact that the movable sash (or the lower sash in the case of a double hung window) is about 50 percent of the overall window height. This is due to the fact that the meeting rails of the two sashes (the top rail of the lower movable sash and the bottom rail of the upper sash (non-movable if single hung and movable if double hung)) substantially overlap in order to reduce the visual blockage of the meeting rails. As the lower sash is raised to its maximum height, its top rail abuts the head of the window frame, such head reducing travel of the lower sash. In this position, the majority, if not all of the bottom rail of the lower sash is below the bottom rail of the upper sash (if the upper sash is closed in the case of a double hung window). This under hang of the bottom rail of the lower sash below the bottom rail of the upper sash results in the vent space being substantially less than 50 percent of the overall window height. Accordingly, if the egress requirement calls for a clear space height of 24 inches, the overall height of the window must be must greater than 48 inches in order to achieve this clear space.

To address this problem, one of two steps is typically taken, aside from not performing the remodel, which remodel may be required for a variety of reasons. One step is to increase the height of the overall rough opening for the window in order to allow a window with suitable height that will allow the window to achieve the appropriate clear space height needed to comply with egress codes. However, such increase in height tends to be costly. Not only must the window header be raised, which is itself difficult, but the remainder of rough opening that is torn out must also be repaired, which includes both interior and exterior finishing, often requiring a variety of tradesman. Depending on the particular structure involved, increasing the height of the rough opening may not even be feasible at almost any cost.

The other common solution to achieve sufficient clear space height in a hung window is to put a casement feature on the single hung (or double hung) window, so that for code meeting egress, the window functions as a casement window wherein both sashes pivot as a unit about one of the side rails of the window frame (or the top rail of the window frame if the code meeting egress casement is in awning style). Such casement clears out both sashes of the window and gives substantially all of the window height as clear space height in order to meet code. This solution, while widely deployed, has its own problems.

Adding the casement features adds additional structure and thus costs to the window. The knuckles must be installed on each sash (or the top sash if employing an awning style casement) as well as the pivot pin within the knuckles must be provided. If a true casement window style (side pivot) is employed, an additional frame element must be overlaid on one of the side rails of the bottom sash so that the window's knuckles are on the same plane. After the window is installed, other tradesman continue to work at the window site, especially interior finishing tradesman that often bang against the window during normal work, or as is often the case, use the window for egress during work. This often causes the casement portion to go out of balance, requiring the window installer to return after departure of such tradesman to rebalance the window. Additionally, as such casement additions are designed only for egress and not to regularly functional as a casement window, the casement components tend to be inferior in construction in relation to standard casement components that must stand up to regular repeated use. As such, the casement operation of the hung window tends to be a single use feature of the window, to be used only during emergencies. Unfortunately, in many deployments, such as college dormitories, the occupants of the dwelling use the casement feature on a regular basis, even to the point of using the window for ingress and egress (some college parties can get wild) so that the window quickly gets out of square with its frame to the point that the casement portion of the window cannot close, requiring the time and expensive of a service call.

What is needed is a hung window that can be retrofitted into an existing window opening during window replacement, which hung window meets the clear space height requirements for egress of the applicable code, wherein a prior art window does not achieve the clear space height. Such a hung window must not rely on a secondary window opening system so as to reduce the overall costs of the window manufacture and after installation maintenance and must be relatively straightforward to install.

SUMMARY OF THE INVENTION

The hung egress window of the present invention addresses the aforementioned needs in the art by providing a typical hung window that achieves a greater clear space height relative to a comparable prior art hung window so that the present invention meets clear space height egress codes where a comparable prior art hung window would not so achieve. The hung egress window does not rely on a secondary opening system, such as a casement system (or awning), to achieve this clear space height in order to reduce manufacturing costs relative to secondary opening window systems. This also eliminates maintenance costs of such secondary opening systems. The hung egress window is of relatively simple design and construction so that it is similar in cost to comparable prior art hung windows in order to make the present invention economically attractive to potential consumers that require code meeting egress clearance heights for a hung window. The hung egress window is installed in similar fashion relative to a comparable prior art hung window The hung egress window of the present invention is comprised of a frame that has a sill with a sill pocket, the sill located at a base of the frame. The frame also has a head located on an opposing end of the frame relative to the base. An upper sash has an upper top rail and an upper bottom rail and is disposed within the frame. The bottom rail has a bottom surface facing toward the base such that a seating pocket is disposed along a first length of the upper bottom rail proximate the bottom surface. A gasket is located along a first length of the seating pocket. A movable lower sash has a lower top rail and a lower bottom rail, the lower sash being slidably disposed within the window. The lower top rail has a top surface facing the head such that a seating flange extends along a third length of the top rail proximate the top surface. The lower sash is slidable between a closed position wherein the lower bottom rail is seated within the sill pocket and the seating flange is seated within the seating pocket and biased by the gasket, and a fully open position wherein the lower top rail abuts the head such that in the fully open position the upper bottom rail and the lower bottom rail substantially coextend with one another. The upper bottom rail and the lower top rail do not substantially coextend with one another whenever the lower sash is in the closed position as a portion of the lower top rail extends below the bottom surface of the upper bottom rail. A portion of the lower bottom rail extends above the sill whenever the lower sash is in the closed position. The frame lacks a head block.

BRIEF DESCRIPTION OF THE DRAWINGS

Similar reference numerals refer to similar parts throughout the several views of the drawings.

DESCRIPTION OF THE PREFERRED EMBODIMENT

Figure 1:
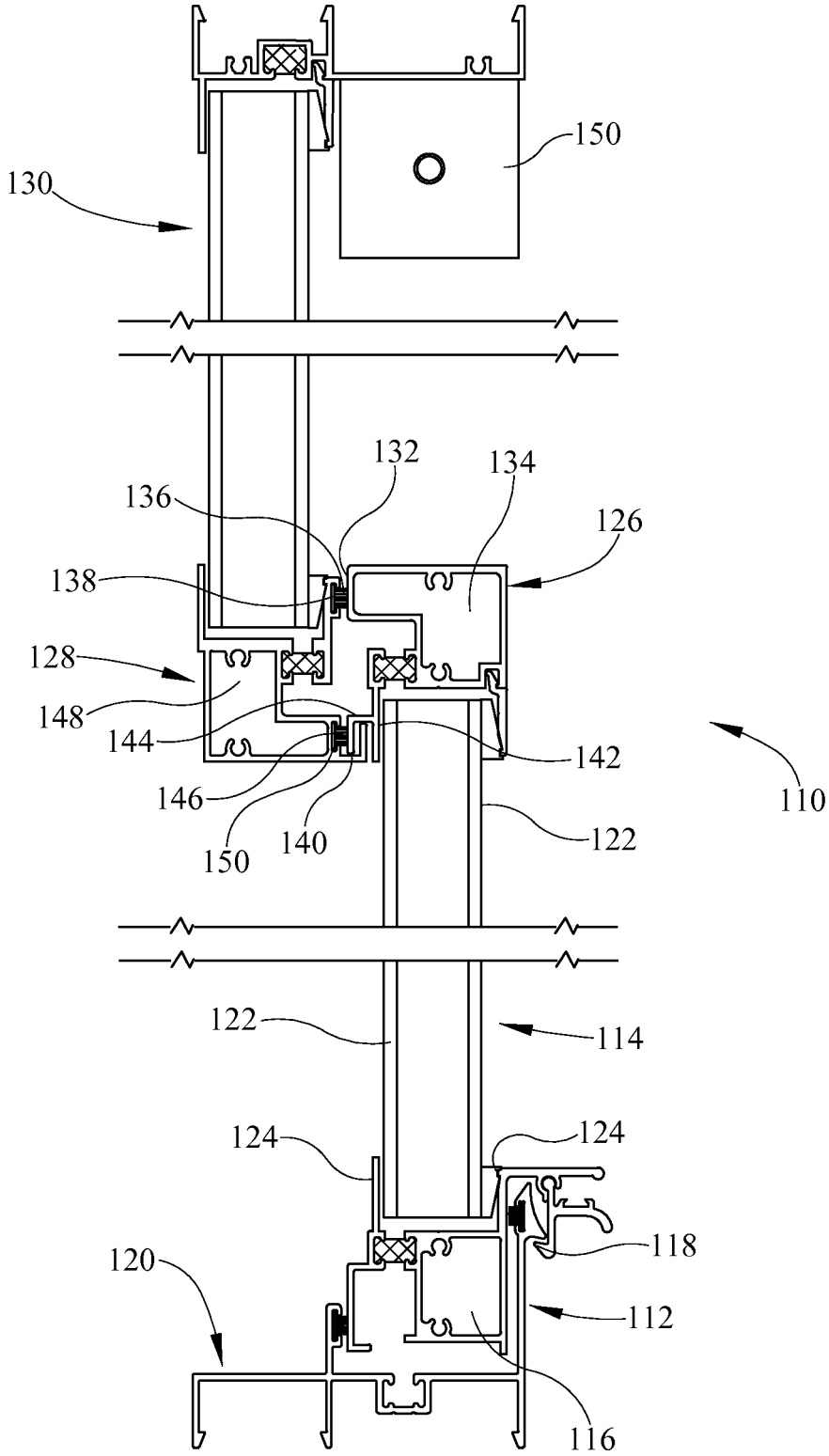
FIG. 1 PRIOR ART
FIG. 1 is a side sectioned view the relevant components of a typical prior art hung window system in a closed position.
Figure 2:
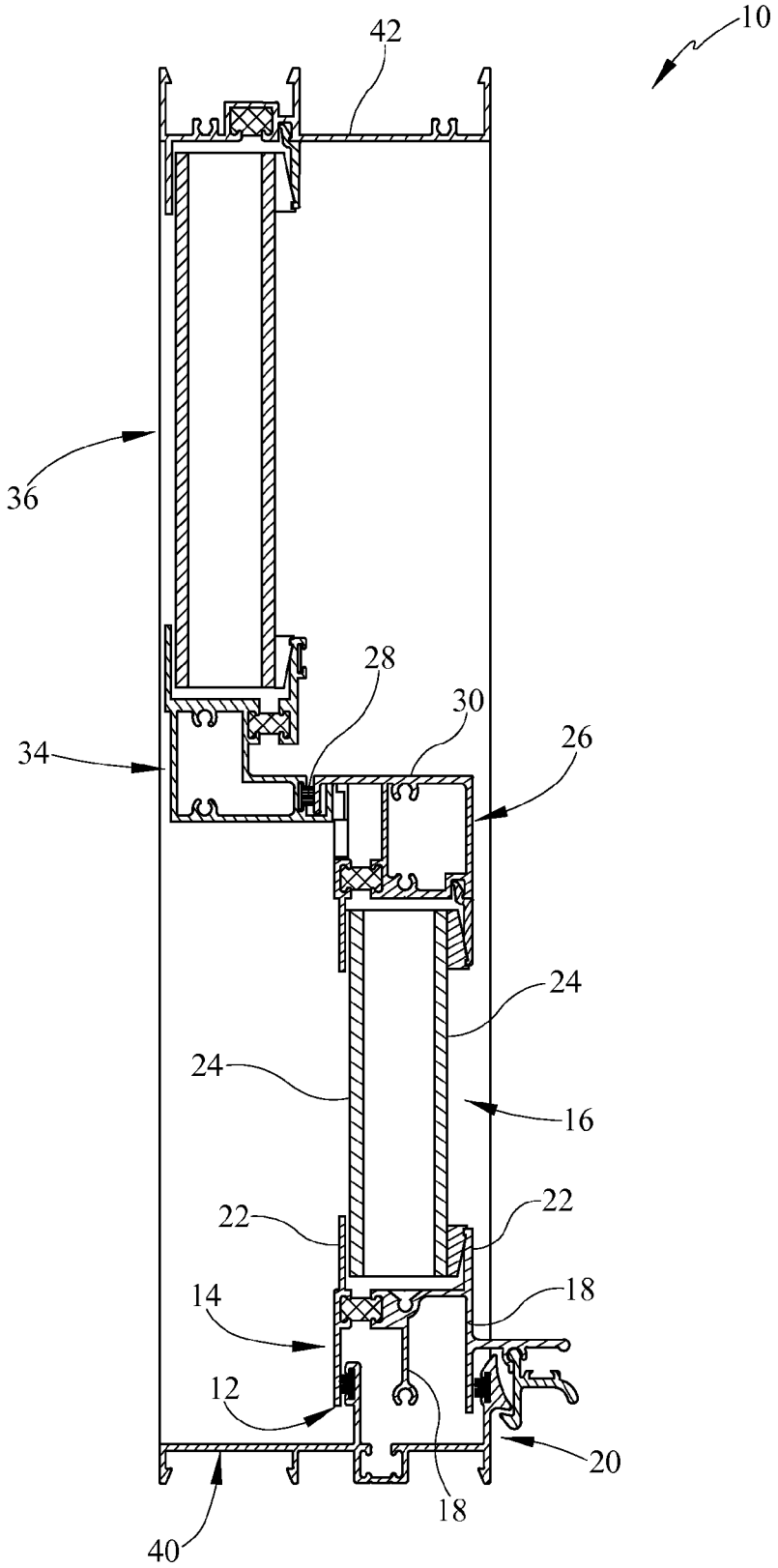
FIG. 2 is a side sectioned view of the relevant components of the hung egress window of the present invention in a closed position taken along line 2-2 in FIG. 5.
Figure 3:
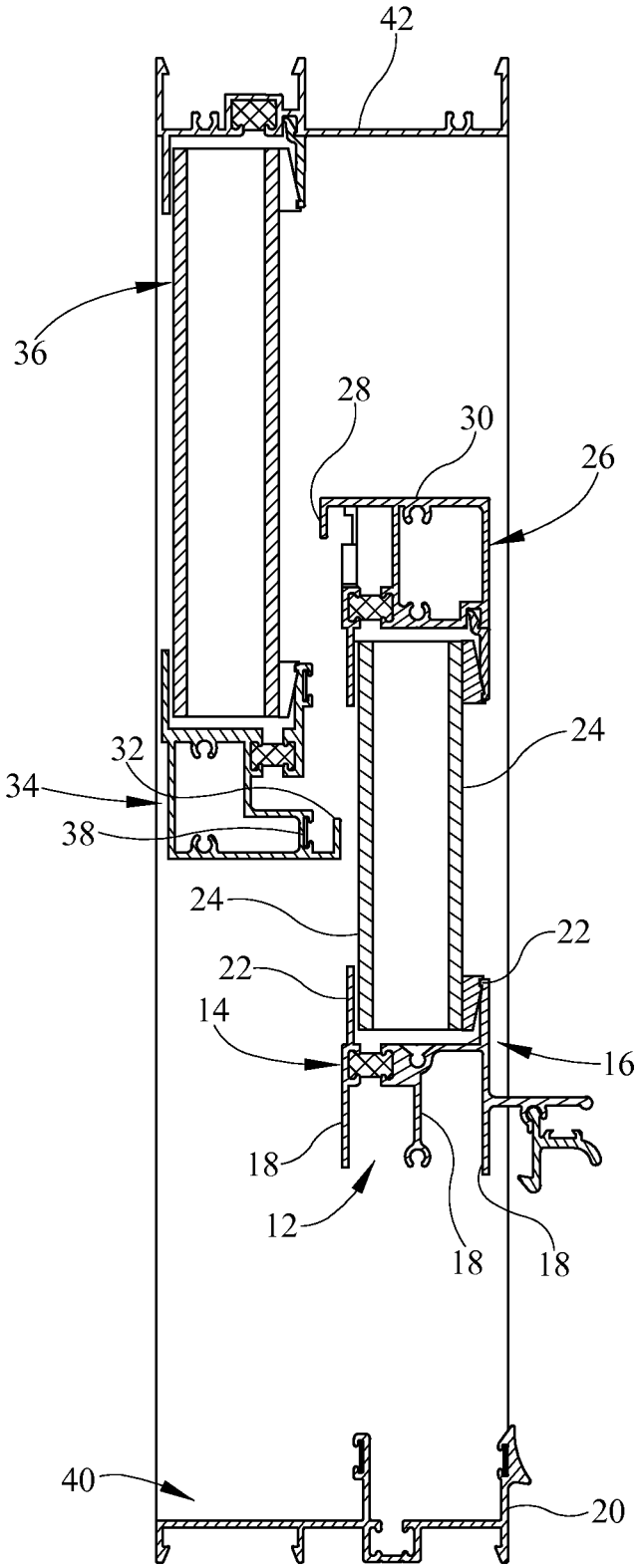
FIG. 3 is a side sectioned view of the relevant components of the hung egress window in a partially open position midway between the position shown in FIGS. 2 and 4.
Figure 4:
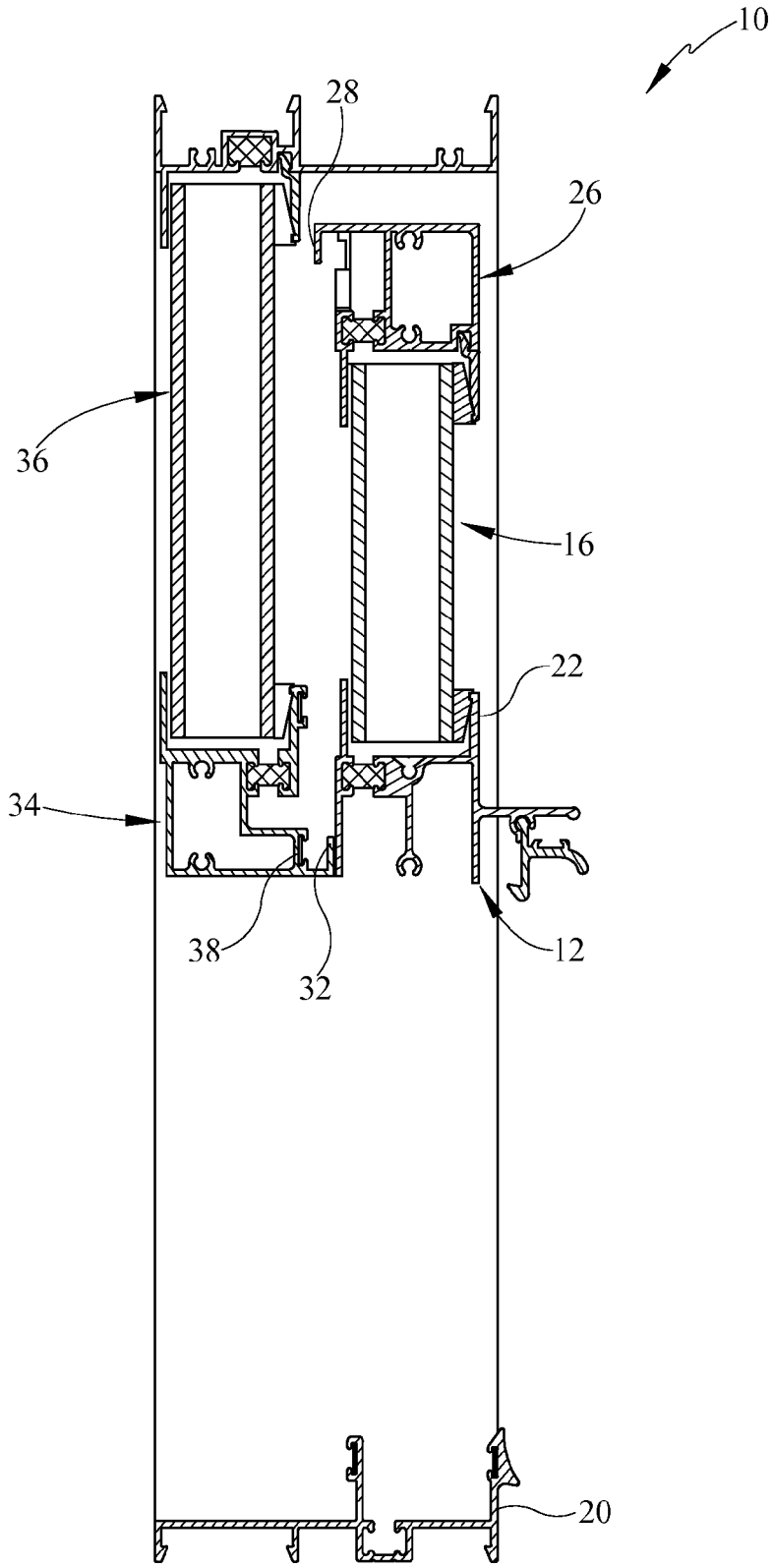
FIG. 4 is a side sectioned view of the relevant components of the hung egress window in a fully open position taken along line 4-4 in FIG. 6.
Figure 5:
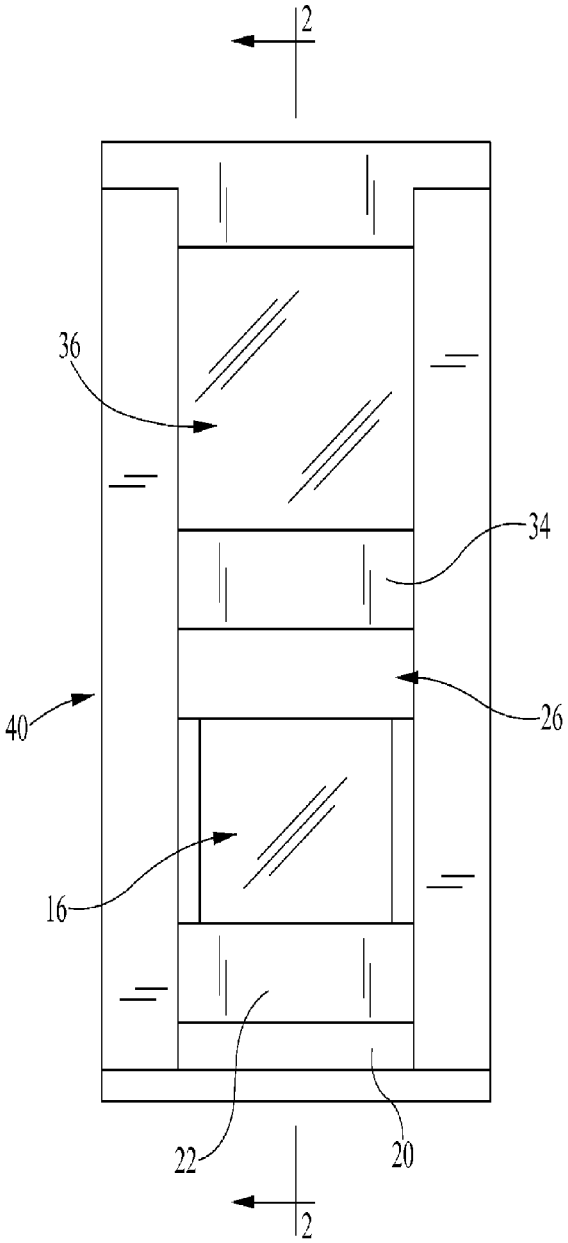
FIG. 5 is an elevation view of the relevant components of the hung egress window in a closed position.
Figure 6:
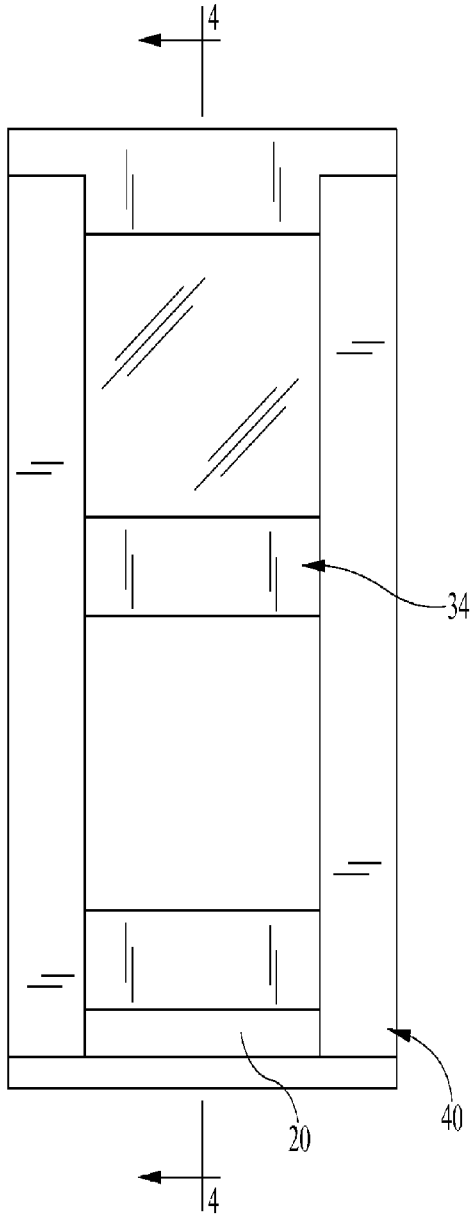
FIG. 6 is an elevation view of the relevant components of my hung egress window in a fully open position.

Referring now to the drawings, it is seen that the hung egress window of the present invention, generally denoted by reference numeral 10, is a typical hung, either single hung or double hung window with certain features changed relevant to a typical prior art hung window 110, the relevant components of such prior art window 110 illustrated in FIG. 1.

Referring to the prior art window 110, it is seen that the bottom rail 112 of the operable (lower) sash 114 has a typical cell structure 116 that seats within the sill 118 of the frame 120. The panes 122 sit within a lower glazing pocket formed by a pair of upright spaced apart flanges 124. The cell structure 116, which comes in a variety of geometries, provides the sash 114 with structural rigidity. This allows the height of the flanges 124 of the lower glazing pocket to be relatively low so that when the window 110 is fully closed, the bottom rail 112 is seated within the sill 118 of the frame 120, and the flanges 124 of the lower glazing pocket are at approximately the same height as the height of the sill 118. This gives the maximum vertical visibility through the panes 122 when the window 110 is closed as the opaque structural components of the lower sash 114 are substantially seated within the sill 118 and thus create no visibility obstruction. The cell structure of the bottom rail 116 gives the lower sash 114 the majority of its structural integrity at this portion with the substantially low profile flanges 124 of the lower glazing pocket coupled with the panes 122 installed within the lower glazing pocket offering the remainder of the needed structural integrity.

Additionally, at the meeting rails whenever the window 110 is closed, the top rail 126 of the lower sash 114 is essentially coextensive with the bottom rail 128 of the upper sash 130. In this configuration, the meeting sashes 126 and 128 have two meeting areas, namely whereat a flange 132 extending along an upper cell 134 (or proximate the top of the cell 134 in a single cell configuration) of the top rail 126 coextends with an upper sealing gasket 136 extending along the lower sash facing flange 138 of the lower glazing pocket of the upper sash 130 and where a seating flange 140 extending along the upper sash facing flange 142 of the upper glazing pocket of the lower sash 114 seats within a receiving pocket 144 extending along a flange 146 along a lower cell 148 (or proximate the bottom of the cell 146 in a single cell configuration) of the bottom rail 128 of the upper sash 130. A lower sealing gasket 150 also extends along the receiving pocket 144 in order to bias against the seating flange 140 of the lower sash 114 to provide sealing redundancy for the upper sealing gasket 136. This configuration allows the main structural components of the top rail 126 of the lower sash 114 to be overlaid by the structural components of the bottom rail 128 of the upper sash 130 which again gives maximum vertical visibility through the lower sash 114 whenever the window is closed.

Additionally, an extended head block 152 is located at the top of the window.

The hung egress window 10 of the present invention makes some important changes to the prior art design. First the profile of the sill seat 12 of the bottom rail 14 of the lower sash 16 is lowered. Basically, the sill seat 12 comprises the various structural flanges 18 that are located below the lower glazing pocket. By having a lower profile of this bottom sash frame 12 of the bottom rail 14, the height of the sill 20 is reduced as the sill seat 12 seats within the sill 20 whenever the hung egress window 10 is in the closed position. The lowering of the profile of the sill seat 12 of the bottom rail 14 reduces the size of the structural cells, or as illustrated, eliminates such cells, so that the structural integrity of the bottom rail 14 is reduced, and the lower sash 16 must compensate for this reduction in structural integrity. This compensation is achieved by raising the height of the flanges 22 of the lower glazing pocket. By raising the height of these flanges 22 increases the contact area of each flange 22 with its respective pane 24 so that the flange 22-pane 24 combination increase the structural integrity of the lower sash 16 thereby offsetting the reduction in structural integrity of the lower sash 16 occasioned by lowering the profile of the sill seat 12. While this does reduce the clear viewing area through the lower part of the lower sash 16 whenever the window 10 is closed, the critical structural integrity of the lower sash 16 and thus the hung egress window 10 is maintained.

The second critical change occurs at the top rail 26 of the lower sash 16. As seen, the seating flange 28 of the top rail 26 is moved to an upper portion of the cell of the top rail 26. This means that the seating flange is no longer located along a flange of the upper glazing pocket, rather the seating flange 28 is located proximate the top 30 of the top rail 26. The seating flange 28 otherwise seats within a seating pocket 32 located along the bottom rail 34 of the upper sash 36. A sealing gasket 38 extends along the seating pocket 32 and biases against the seating flange 28 in the usual way. In this configuration, the majority of the top rail 26 of the lower sash 16 is located below the bottom rail 34 of the upper sash 36 which means that the top 30 of the top rail 26 is located lower within the window frame 40 relative to the prior art window 110 of the same height. While this reduces the clear viewing area through the upper part of the lower portion of the window (now both the top rail 26 of lower sash 16 and the bottom rail 34 of upper sash 36 substantially contribute to blocking the view) whenever the hung egress window 10 is closed, the lower sash 16 is able to travel a greater distance upwardly prior to reaching the head block lacking head 42 of the window frame 40, the lower sash 16 opens more relative to the lower sash 114 of the prior art window 110. When the lower sash 16 is fully raised, its bottom rail 14 is substantially coextensive with the bottom rail 34 of the upper sash 36 (as opposed to the bottom rail 116 of the lower sash 114 being most below the bottom rail 128 of the upper sash 130 in the prior art window 110) so that there is more clear viewing area at this portion of the hung egress window 10. More importantly, by having the lower sash 16 travel a greater distance, means that the distance between the top of the sill 20 and the bottom of the bottom rail 14 is increased so that the height of the clear vent space is increased. While this configuration reduces the redundancy of having two sealing gaskets, modern technology allows the sealing between the meeting rails 16 and 34 to be substantially sound using only a single sealing gasket 38.

Of course, due to the increase of distance traveled by the lower sash 16, the overall length of the balances attached to the side rails of the frame need to correspondingly increase to allow this greater travel distance.

It is noted that a typical slider window is simply a hung window essentially turned 90 degrees, so that the movable sash in the case of a single slider acts as the lower sash of a hung window. The present invention applies to slider windows when width distances are of concern.

The decrease in the height of the sill 20 coupled with the increase in the distance the lower sash 16 travels between the closed and open position, increases the overall height of the clear vent space relative to the prior art window 110 so that a smaller hung egress window 10 can achieve the required vertical clear vent space height relative to the prior art window 110.

While the invention has been particularly shown and described with reference to an embodiment thereof, it will be appreciated by those skilled in the art that various changes in form and detail may be made without departing from the spirit and scope of the invention.

I claim:

1. A hung window comprising:

a frame having a sill with a sill pocket, the sill located at a base of the frame, the frame also having a head located on an opposing end of the frame relative to the base;

an upper sash having an upper top rail and an upper bottom rail, the upper sash disposed within the frame with the upper top rail abutting the head, the bottom rail having a bottom surface facing toward the base and located on a first horizontal plane, such that a seating pocket is disposed along a first length of the upper bottom rail proximate the bottom surface and a gasket located along a first length of the seating pocket; and a movable lower sash having a lower top rail and a lower bottom rail, the lower sash slidably disposed within the frame, the lower top rail having a top surface facing the head and located on a second horizontal plane such that a seating flange extends along a third length of the lower top rail proximate the top surface, the lower sash slidable between a closed position wherein the lower bottom rail is seated within the sill pocket and the seating flange is seated within the seating pocket and biased by the gasket, and a fully open position wherein the lower top rail abuts the head such that in the fully open position the upper bottom rail and the lower bottom rail substantially coextend with one another and such that the lower bottom rail does not extend below the first horizontal plane of the bottom surface of the upper bottom rail.

2. The hung window as in claim 1 wherein the upper bottom rail and the lower top rail do not substantially overlap with one another whenever the lower sash is in the closed position as a portion of the lower top rail extends below the bottom surface of the upper bottom rail.

3. The hung window as in claim 2 wherein a portion of the lower bottom rail extends above the sill whenever the lower sash is in the closed position.

4. The hung window as in claim 3 wherein the head lacks a head block.

5. The hung window as in claim 2 wherein a pair of glazing flanges is located on the lower bottom rail and each extends upwardly and each holds a pane of glazing, each glazing flange extends above the sill whenever the lower sash is in the closed position.

6. The hung window as in claim 1 wherein a portion of the lower bottom rail extends above the sill whenever the lower sash is in the closed position.

7. The hung window as in claim 1 wherein the head lacks a head block.

8. The hung window as in claim 1 wherein a pair of glazing flanges is located on the lower bottom rail and each extends upwardly and each holds a pane of glazing, each glazing flange extends above the sill whenever the lower sash is in the closed position.

9. The hung window as in claim 1 wherein the second horizontal plane of the lower top rail is located below a glazing pocket holding at least one pane of glazing, the glazing pocket located on the upper bottom rail.

* * * * *